US010866072B2

(12) United States Patent
Imhoff et al.

(10) Patent No.: US 10,866,072 B2
(45) Date of Patent: Dec. 15, 2020

(54) MULTI-PIECE CARTRIDGE CASING AND METHOD OF MAKING

(71) Applicant: Sig Sauer, Inc., Newington, NH (US)

(72) Inventors: Jason W. Imhoff, Newington, NH (US); Thomas J. Burczynski, Montour Falls, NY (US)

(73) Assignee: Sig Sauer, Inc., Newington, NH (US)

( * ) Notice: Subject to any disclaimer, the term of this patent is extended or adjusted under 35 U.S.C. 154(b) by 64 days.

(21) Appl. No.: 16/252,489

(22) Filed: Jan. 18, 2019

(65) Prior Publication Data

US 2019/0226817 A1 Jul. 25, 2019

Related U.S. Application Data

(60) Provisional application No. 62/619,887, filed on Jan. 21, 2018.

(51) Int. Cl.
*F42B 5/285* (2006.01)

(52) U.S. Cl.
CPC ..... *F42B 5/285* (2013.01)

(58) Field of Classification Search
CPC .. F42B 5/26; F42B 5/285; F42B 5/307; F42B 5/313
See application file for complete search history.

(56) References Cited

U.S. PATENT DOCUMENTS 125,830 A 4/1872 Milbank
159,665 A 2/1875 Gauthey
2,294,822 A 9/1942 Albree
2,654,319 A * 10/1953 Roske ..... F42B 5/307 102/467
3,143,966 A 8/1964 Burns, Jr. et al.
3,984,259 A 10/1976 Rogers, Jr. et al.
4,041,868 A 8/1977 Rayle et al.
4,147,107 A 4/1979 Ringdal
4,336,756 A 6/1982 Schreiber
4,352,225 A 10/1982 Schreiber
4,810,810 A 3/1989 Kramer et al.
4,856,160 A 8/1989 Habbe et al.
(Continued)

FOREIGN PATENT DOCUMENTS

DE 1905103 A1 * 8/1970 ..... F42B 5/307
DE 1960355 A1 * 6/1971 ..... F42B 5/307
(Continued)

OTHER PUBLICATIONS

Hornady Website Page, Interlock Rifle Bullet (Jun. 27, 2017). 1 page.
U.S. Appl. No. 62/619,887, filed Jan. 21, 2018, Pending.

*Primary Examiner* — Gabriel J. Klein
(74) *Attorney, Agent, or Firm* — Finch & Maloney PLLC

(57) ABSTRACT

A multi-piece ammunition cartridge casing includes a casing base extending along a central axis and defining an opening extending axially into the casing base from the distal base end. The inner casing surface defines a circumferential groove with a groove radius greater than a radius of an adjacent portion of the opening. The cartridge casing also includes a casing body with a proximal end portion disposed in the opening of the casing base. The casing body is secured to the casing base by way of a flange protruding radially outward in mating contact with the circumferential groove.

22 Claims, 8 Drawing Sheets

(56) References Cited

U.S. PATENT DOCUMENTS

| | | | | |
|---|---|---|---|---|
| 7,658,137 | B1 | 2/2010 | Romero | |
| 8,141,494 | B2 | 3/2012 | Riess et al. | |
| 8,813,650 | B2 | 8/2014 | Maljkovic et al. | |
| 9,188,414 | B2 | 11/2015 | Burczynski | |
| 9,625,241 | B2 | 4/2017 | Neugebauer | |
| 9,709,367 | B2 | 7/2017 | Neugebauer | |
| 9,939,236 | B2 | 4/2018 | Drobockyi et al. | |
| 10,041,773 | B2 | 8/2018 | Peterson | |
| 2014/0060373 | A1* | 3/2014 | Maljkovic | F42B 33/10 102/467 |
| 2017/0030690 | A1 | 2/2017 | Viggiano et al. | |
| 2017/0030692 | A1 | 2/2017 | Drobockyi et al. | |
| 2017/0261296 | A1* | 9/2017 | Burrow | F42B 5/26 |
| 2017/0307343 | A1* | 10/2017 | Baxter | F42B 5/29 |
| 2018/0321020 | A1* | 11/2018 | Evans | F42B 5/285 |

FOREIGN PATENT DOCUMENTS

| | | | | |
|---|---|---|---|---|
| DE | 2205619 | A1 * | 8/1972 | F42B 5/313 |
| EP | 2012083 | A1 | 1/2009 | |
| GB | 498080 | A * | 1/1939 | F42B 5/285 |
| WO | WO-8907496 | A1 * | 8/1989 | F42B 5/307 |
| WO | WO-9513516 | A1 * | 5/1995 | F42B 5/307 |
| WO | WO-2019143974 | A1 * | 7/2019 | F42B 5/26 |

* cited by examiner

MULTI-PIECE CARTRIDGE CASING AND METHOD OF MAKING

RELATED APPLICATIONS

This application claims priority under 35 U.S.C. § 119(e) to U.S. Provisional Patent Application No. 62/619,887 titled MULTI-PIECE CARTRIDGE CASING AND METHOD OF MAKING, and filed on Jan. 21, 2018, the contents of which are incorporated herein by reference in its entirety.

FIELD OF THE DISCLOSURE

The present disclosure relates generally to firearm ammunition. Specifically, the present disclosure relates to a multi-piece cartridge casing for firearm ammunition and a method of manufacturing the same.

BACKGROUND

Firearms, such as handguns and rifles, are used for military operations, law enforcement, hunting, shooting sports, and self-defense. The firearm is configured to fire ammunition to launch a projectile through the barrel to a target. Ammunition for modern-day arms has four main components that include the cartridge casing, a primer retained in the head of the cartridge casing, a propellant in the body of the cartridge casing, and a projectile retained in the mouth of the cartridge casing. The firing pin or striker of the firearm impacts the primer, causing it to explode and in turn ignite the propellant in a rapid combustion that generates thousands of pounds of pressure to propel the projectile through the barrel. Like the design of firearms, the design and manufacture of firearm ammunition has many non-trivial challenges.

SUMMARY OF THE DISCLOSURE

Embodiments of the present disclosure relate generally to a multi-piece cartridge casing, firearm ammunition utilizing a multi-piece cartridge casing, and methods for making the same.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
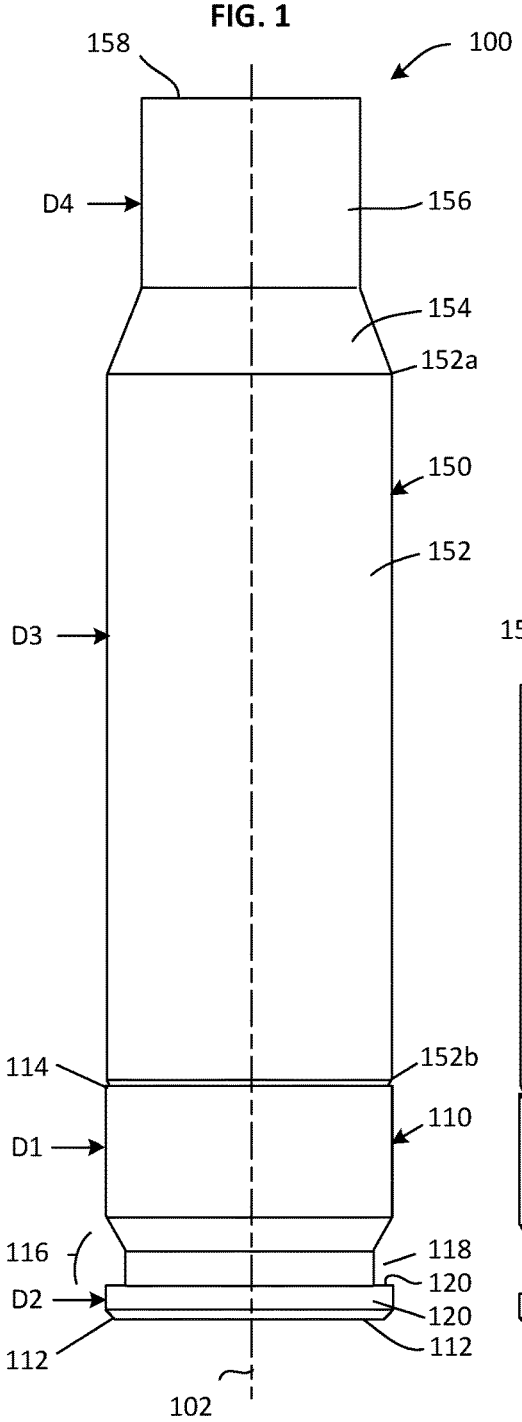
FIG. 1 is an elevational view of a multi-piece cartridge casing, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

The present disclosure is generally directed to embodiments of a multi-piece cartridge casing for firearm ammunition. In accordance with embodiments of the present disclosure, a multi-piece cartridge casing includes a casing base and a casing body, where a proximal end portion of the casing body is received in an opening extending into the casing base from the distal base end. The casing body is secured to the casing base by a flange, rib, or other structure on proximal end portion that occupies the inner recess. In example embodiments, the casing base can be made of metal, such as brass, steel, aluminum alloy, or titanium alloy to name a few examples. The casing body can be made of the same or a different material, such as a second metal.

The casing body generally has a hollow, cylindrical shape that extends to an open mouth configured to retain a projectile. The casing body can have a necked configuration, such as for rifle ammunition, or a generally straight configuration, such as for pistol ammunition. In some embodiments, the head of the casing base defines a primer recess for an ammunition primer, such as used in centerfire ammunition. A flash opening extends between the primer recess and the opening in the casing body. A quantity of propellant can be disposed in the casing body between the projectile and the primer.

The present disclosure also relates to a method of making a multi-piece cartridge casing. In one embodiment, the method includes providing a metal cartridge base extending from a cartridge head to an open distal base end, where the casing base defines an opening into the distal base end. The casing base is constructed to receive a proximal end portion of a casing body preform. The casing base defines a circumferential recess or groove in the inside wall of the opening. Also provided is a casing body preform having a hollow, generally cylindrical sleeve portion extending along a central axis. A proximal end portion of the casing body preform has a diameter less than that of the sleeve portion. For example, the proximal end portion defines a sleeve shoulder and a generally cylindrical cup portion. The proximal end portion of the casing body preform is placed into the casing base with a proximal wall in contact with an inner face of the casing base. The proximal end portion is deformed to define a flange, protrusion, rib, or the like that extends radially outward and occupies the inner recess in the casing base, thereby securing the casing body to the casing base. In some embodiments, an annular washer or expansion member is placed against the inside surface of the proximal wall of the casing body preform. When the proximal end portion of the casing body preform is deformed, the washer is compressed axially and therefore expands radially outward to occupy a space between portions of the flange defined by the material of the cup portion. In doing so, the washer reinforces the flange and facilitates a seal between the casing body and the casing base. Numerous embodiments and variations will be apparent in light of the present disclosure. The casing base and the casing body can be made of the same or compositionally different materials.

As discussed herein, "dissimilar materials" or "compositionally distinct," or "compositionally different" materials as used herein refer to two materials that have different chemical compositions. This compositional difference may be, for instance, by virtue of an element that is in one material but not the other (e.g., aluminum alloy 7075 is compositionally different from aluminum alloy 2011), or by way of one material having all the same elements as a second material but at least one of those elements is intentionally provided at a different concentration in one material relative to the other material (e.g., brass having 70% copper and 30% zinc is compositionally different from brass having 69% copper and 31% zinc).

Also, it should be noted that, while generally referred to herein as a "cartridge casing" for consistency and ease of understanding the present disclosure, the disclosed cartridge casing is not limited to that specific terminology and alternatively can be referred to, for example, as a casing, a shell, a shell casing, or other terms.

As will be further appreciated, the particular configuration (e.g., materials, dimensions, etc.) of a cartridge casing configured as described herein may be varied, for example, depending on whether the intended use of the completed ammunition utilizing the cartridge casing. Numerous configurations will be apparent in light of this disclosure.

General Overview

Centerfire ammunition cartridges have traditionally been made with one-piece, solid-drawn metallic cases. Such cartridges have been used almost universally in small arms ammunition, including military rifles, sporting rifles, and handguns. The cartridge casing, traditionally made of brass, has a generally cylindrical shape that extends from a closed end or casing head to an open mouth that retains the projectile. The casing head defines a central primer pocket configured to house a primer, which, upon impact from the firearm's hammer or firing pin, ignites through a flash opening and in turn ignites the propellant contained in the casing body. The casing head can define a rim to be engaged by the firearm extractor to remove the empty cartridge casing from the firearm. The distal end portion of the casing body may be necked or straight, depending on the type and caliber of ammunition, as will be appreciated.

Brass has been used extensively for cartridge casings due to its mechanical strength and ductility that allows it to be formed into a hollow cylindrical shape using a drawing process. Brass is also sufficiently elastic, allowing the casing to expand against the chamber wall upon firing and return after firing to its approximate pre-fired shape for easy extraction from the chamber. However, brass is a relatively heavy metal that has a density comparable to that of steel (-8.5 g/cm$^3$ for cartridge brass vs. ~8.0 g/cm$^3$ for steel). Accordingly, brass-cased ammunition is heavy, especially in large quantities. In addition, the price of brass has become expensive in recent years due to the increased cost of copper, leading to corresponding increases in the cost of ammunition.

To reduce the cost, some attempts have been made to produce cartridge casings from other metals, such as steel and aluminum. However, cartridge casings made entirely from steel or aluminum have other challenges. Although steel is less expensive than brass, steel is almost as dense as brass and therefore provides only a modest weight advantage at best, even when a thinner casing wall is used. Steel casings also typically need a polymer coating to inhibit corrosion. Aluminum is another material chosen for casings since it has a lower density (~2.7 g/cm$^3$) and is less expensive than brass. However, aluminum of low tensile strength can result in a casing failure when subjected to the pressures typically observed (e.g., up to 62,000 psi) in some firearms casings upon firing.

In addition to weight and cost, corrosion resistance, ductility, firearm wear, and ammunition performance are among the factors that are considered in choosing materials for a cartridge casing. Depending on whether the end use is military, target shooting, competition shooting, hunting, or other use, the deciding factor(s) may be very different. In light of the aforementioned challenges, a need exists for a multi-piece cartridge casing for firearm ammunition. Various embodiments of the present disclosure address this need.

Example Casing Configurations

Figure 2:
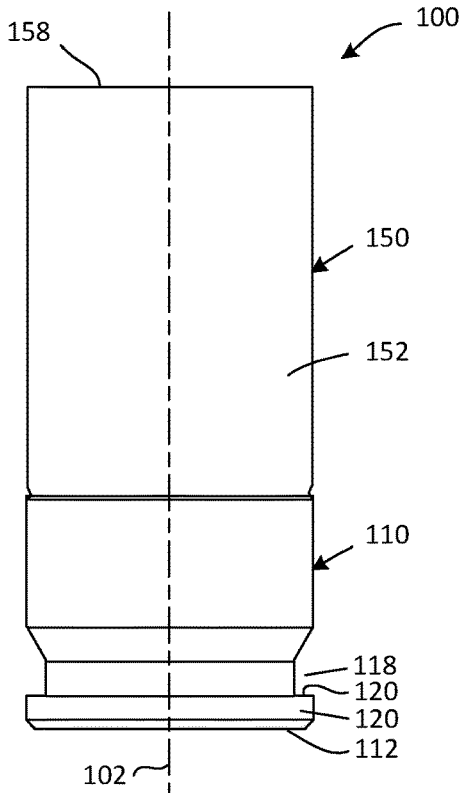
FIG. 2 is an elevational view of a multi-piece cartridge casing, in accordance with another embodiment of the present disclosure.

FIGS. 1 and 2 illustrate elevational views of an assembled cartridge casing 100, in accordance with some embodiments of the present disclosure. Cartridge casing 100 extends along a central axis 102 and has a generally cylindrical shape that includes a casing base 110 made of a first material and a casing body 150 made of a second material of the same or different composition. Casing body 150 is secured to casing base 110 by engagement with a proximal end portion 160 (not shown in FIGS. 1-2) of casing body 150 as will be discussed in more detail below.

In both embodiments of cartridge casing 100 shown in FIGS. 1-2, casing base 110 has a generally cylindrical shape that extends axially from a proximal base end 112 to a distal base end 114 with an outer surface of a diameter Dl. In some embodiments, casing base 110 has a casing head 116 that defines an extraction groove 118 and a rim 120 adjacent proximal base end 112. For example, extraction groove 118 is a circumferential region of reduced diameter adjacent proximal base end 112 that defines rim 120 with a distally-facing surface 122. Accordingly, rim 120 is configured for engagement by a firearm extractor to remove cartridge casing 100 from the firearm, as will be appreciated. Here, since rim 120 is shown as having an outer diameter D2 equal to diameter D1 of the outer surface of the casing base 110, the cartridge casing is considered a rimless configuration. It is contemplated, however, that casing base 110 can have any configuration, including rimless, rimmed, semi-rimmed, rebated rim, or "belted", as will be appreciated.

Casing body 150 has a hollow, cylindrical sleeve portion 152 extending along central axis 102. Casing body 150 of FIG. 1 is consistent with rifle ammunition and includes a casing shoulder 154 connected to and extending distally from a proximal end 152*a* of sleeve portion 152, and a neck portion 156 extending distally from casing shoulder 154 to an open mouth 158. Casing shoulder 154 has a generally frustoconical shape that tapers from diameter D3 of sleeve portion 152 to the smaller diameter D4 of neck portion 156. Diameter D3 of sleeve portion 156 is equal to diameter D1 of casing base 110 within manufacturing tolerances. Neck 156 has a cylindrical shape and extends from casing shoulder 154 to an open mouth 158.

Cartridge casing 100 of FIG. 2 is consistent with some un-necked ammunition, where casing body 150 extends along central axis 102 to open mouth 158 without casing shoulder 152 or neck portion 156. Cartridge casing 100 is not limited to rifle and pistol ammunition and can be configured for any type, style, and caliber of ammunition, as will be appreciated.

Figure 3:
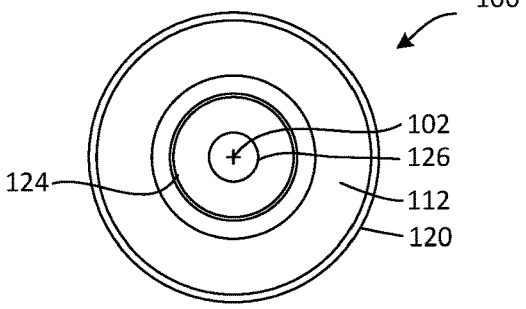
FIG. 3 is an end view of cartridge casing, in accordance with an embodiment of the present disclosure.

FIG. 3 illustrates an elevational view of proximal base end 112 in accordance with some embodiments. Casing base 110 defines a primer pocket 124 that extends axially into casing base 110 and is configured to retain a primer. Consistent with centerfire ammunition, primer pocket 124 is centered on central axis 102. A flash opening 126 extends through casing base 110 along central axis 102.

Figure 4:
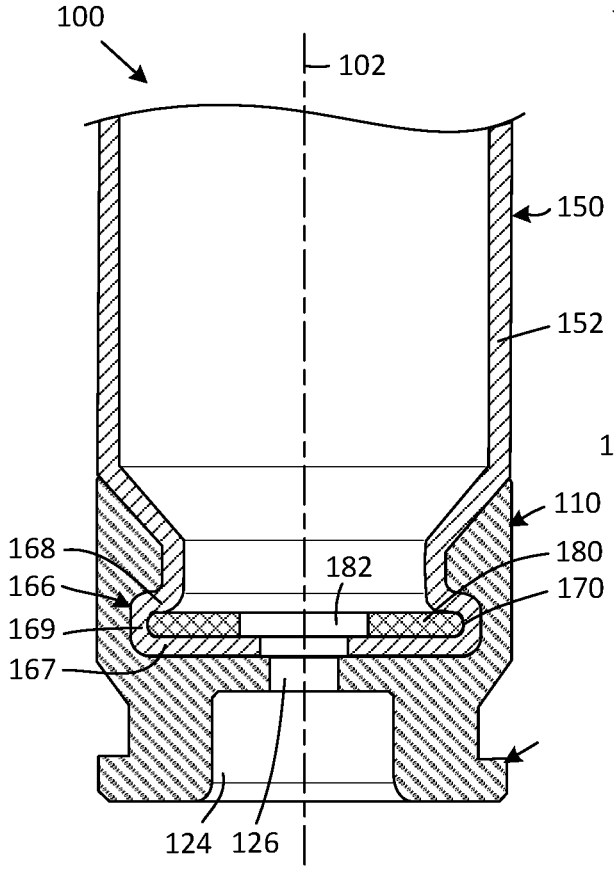
FIG. 4 is a cross-sectional view of a portion of a multi-piece cartridge casing in assembled form showing a cartridge body, a cartridge base, and a washer, in accordance with an embodiment of the present disclosure.
Figure 4A:
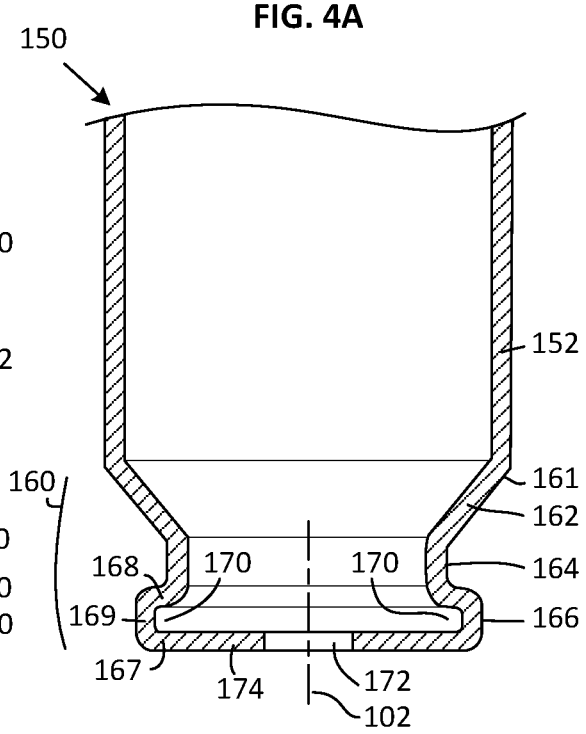
FIG. 4A is a cross-sectional view showing the casing body as illustrated in FIG. 4.
Figure 4B:
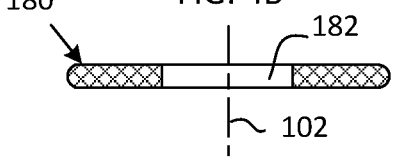
FIG. 4B is a cross-sectional view showing the washer as illustrated in FIG. 4.
Figure 4D:
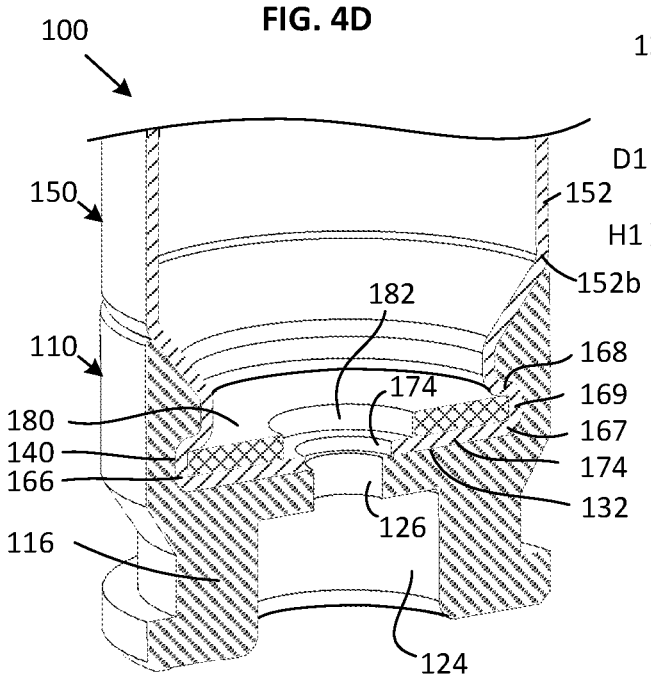
FIG. 4D is a perspective, cross-sectional view of the cartridge casing of FIG. 4.
Figure 4C:
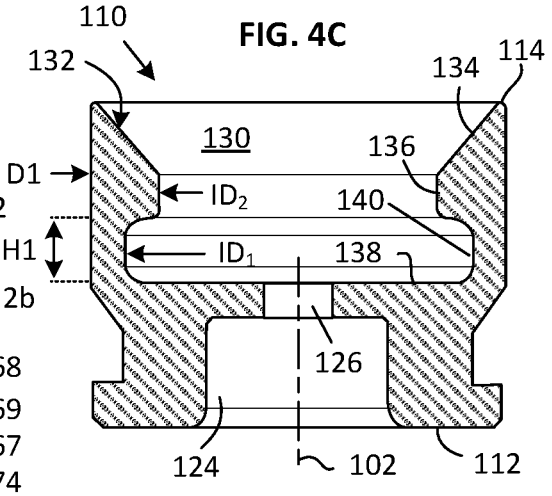
FIG. 4C is a cross-sectional view of the casing base as illustrated in FIG. 4.

Referring now to FIGS. 4 and 4A-4D, cross-sectional views illustrate a portion of cartridge casing 100 and individual components of cartridge casing 100, in accordance with an embodiment of the present disclosure. FIG. 4 shows a cross-sectional view of casing body 150 assembled with casing base 110 and including an annular washer 180. FIGS. 4A-4C illustrate cross-sectional views of casing body 150, washer 180, and casing base 110, respectively, as individual components of the embodiment shown in FIG. 4. Note that a proximal end portion 160 of casing body 150 shown in FIG. 4A includes flange 166 that is formed during assembly with casing base 110. Accordingly, casing body 150 of FIG. 4A is shown for convenience in describing the features of the assembled cartridge casing 100; however, a casing body preform 150' (shown in FIGS. 9 & 12) generally has different geometry as will be discussed below. FIG. 4D illustrates a perspective, cross-sectional view showing part of cartridge casing 100 as illustrated in FIG. 4.

When casing body 150 is assembled with casing base 110, proximal end portion 160 occupies an opening 130 extending axially into casing base 110. Due to the high-pressure process used to assemble cartridge casing 100 in some embodiments, which is discussed in more detail below, proximal end portion 160 can be deformed to define a flange 166 that occupies and mates with a circumferential groove 140 in inner casing surface 132 of casing base 110, in accordance with some embodiments.

Casing body 150 has proximal end portion 160 connected to proximal sleeve end 152*b* of sleeve portion 152. Proximal end portion 160 includes a sleeve shoulder 162 extending proximally and radially inward from proximal sleeve end 152*b* to an axial sidewall 164. Axial sidewall 164 has a generally cylindrical shape that extends along central axis 102 towards a proximal body wall 174. Proximal body wall 174 extends generally perpendicular to central axis 102 across opposite portions of proximal end portion 160 (e.g., axial sidewall 164 or flange 166). Proximal body wall 174 defines a central opening 172 aligned with flash opening 126 and with primer pocket 124 along central axis 102. In some embodiments, proximal body wall 174 is closed except for central opening 172. In some embodiments, central opening 172 through proximal body wall 174 is the same size or larger than flash opening 126. Central opening 172 and flash opening 126 are generally circular in shape, but can have other shapes, as will be appreciated.

Prior to assembly with casing base 110, axial sidewall 164 extends to proximal body wall 174 to define a cup shape in some embodiments. After being assembled with casing base 110 using a press or other process, the cup shape of proximal end portion 160 is deformed to define a flange 166 that extends radially outward from axial sidewall 164 as illustrated, for example, in FIG. 4. Flange 166 is complementary to, and mates with, circumferential groove 140 of casing base 110. In some embodiments, flange 166 has a proximal flange portion 167 and a distal flange portion 168 that are spaced apart and connected by a flange sidewall 169 extending axially therebetween. For example, the sidewall of proximal end portion 160 conforms to circumferential groove 140 to define proximal flange portion 167 and distal flange portion 168 that each extend generally perpendicular to central axis 102. The spaced-apart flange portions 167, 168 define a locking chamber 170 configured to be occupied by washer 180, in accordance with some embodiments.

In some embodiments, proximal flange portion 167 is continuous with proximal body wall 174, where proximal flange portion 167 and proximal body wall 174 contact inner face 138 of casing base 110. Such an embodiment occurs when flange 166 is located proximally of axial sidewall 164 as shown, for example, in FIG. 4. In other embodiments, flange 166 is located along axial sidewall 164 where proximal body wall 174 is spaced from proximal flange portion 167 by a proximal portion 164a of axial sidewall 164, such as the example shown in FIG. 5.

In some embodiments, such as shown in FIGS. 4 and 4D, annular washer 180 occupies locking chamber 170 in the assembled cartridge casing 100. Washer 180 can have an annular shape that defines a central through opening 182, such as a ring, disk, frustum, or a hoop. The material of washer 180 can be the same as or different compared to casing body 150. For example, washer 180 can be made of a metal or polymer material. Examples of acceptable metals have a Brinell Hardness from B30 to B101 and include, for example, dead-soft (pure) aluminum, aluminum alloys, soft copper, copper alloys, and soft brass. Examples of acceptable polymers have a Shore Hardness from D55 to D86 and include, for example, acrylonitrile butadiene styrene (ABS), acetal, low density polyethylene (LDPE), high density polyethylene (HDPE), high-impact polystyrene, nylon, polycarbonate, polypropylene, polyvinylchloride (PVC), and polyetherimide (PEI). An example of an acceptable polyetherimide is Ultem® thermoplastic made by Saudi Basic Industries Corp. (SABIC)).

In some embodiments, washer 180 can be formed during assembly to extend radially outward and into locking chamber 170 between proximal and distal flange portions 167, 168. When present, expansion washer 180 is useful to cause and/or to maintain continuous contact between flange 166 and circumferential groove 140. Washer 180 reinforces flange 166 and prevents deformation or collapse of the flange structure when the cartridge is fired, thereby preventing gas leaks between casing base 110 and casing body 150.

Figure 6:
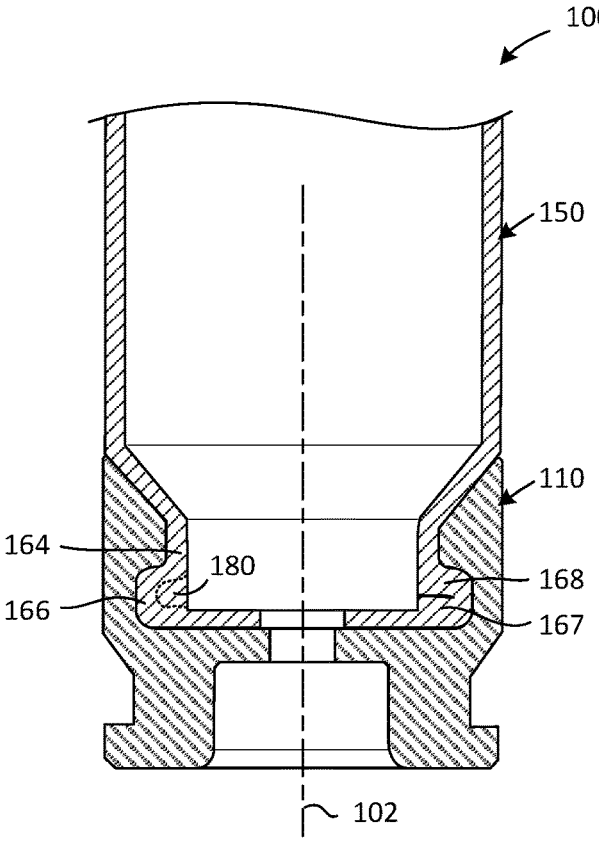
FIG. 6 is a cross-sectional view of a cartridge casing showing examples of flange structures, in accordance with some embodiments of the present disclosure.

In some embodiments, such as shown in FIG. 6, flange 166 can be formed as a solid or mostly solid structure, such as a circumferential rib or the like that protrudes radially outward from axial sidewall 164 to occupy circumferential groove 140. In one example, distal flange portion 168 folds back on and contacts proximal flange portion 167, such as shown at the right side of FIG. 6. In another embodiment, expansion washer 180 can be formed with material of proximal end portion 160 to define flange 166 as a monolithic structure that fills circumferential groove 140. In some embodiments, flange 166 is formed to have inner surfaces aligned with axial sidewall 164, such as shown on the left side of FIG. 6. In such embodiments, the material of expansion washer 180 may partially fold into or otherwise intermingle with the material of proximal end portion 160 during the assembly process. Note that FIG. 6 illustrates examples of two embodiments of flange 166 that do not normally exist together in a single embodiment of cartridge casing 100 as shown.

Figure 5:
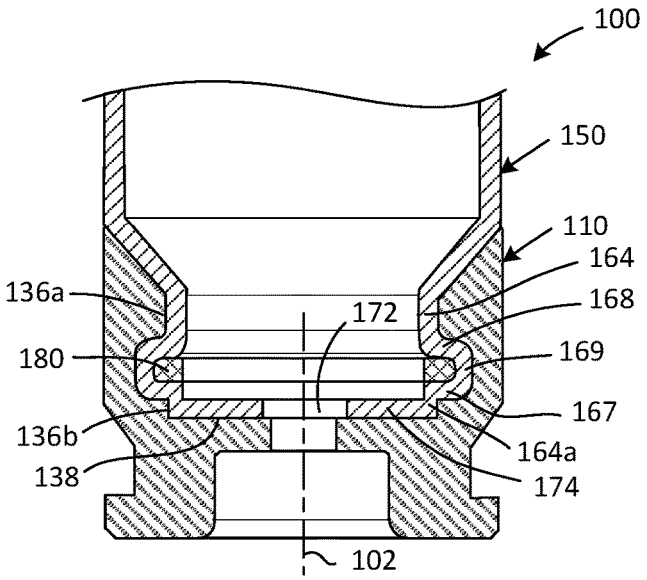
FIG. 5 is a cross-sectional view of a cartridge casing showing the flange axially spaced from the proximal body wall of the casing body, in accordance with an embodiment of the present disclosure.

With continued reference to FIGS. 4 and 4A-4D, casing base 110 has an opening 130 that extends axially from distal base end 114 and defines an open region bounded by an inner casing surface 132. In some embodiments, inner casing surface 132 includes a shoulder portion 134 extending proximally and radially inward from distal base end 114 with a generally frustoconical shape. In some embodiments, shoulder portion 134 defines a shoulder angle a with central axis 102 from 20° to 60°, such as from 30° to 45°. In other embodiments, shoulder angle a is less than 20° or greater than 60°. Inner surface also includes an axial portion 136 with a generally cylindrical sidewall that extends along central axis 102 from shoulder portion 134 towards a distally-facing inner face 138. In some embodiments, sidewall of axial portion 136 is parallel to central axis 102. In other embodiments, sidewall of axial portion 136 deviates slightly (e.g., ±5°) from being parallel to central axis 102 as may result from, or be preferred for, certain manufacturing techniques, as will be appreciated. A circumferential groove 140 is a recess in inner casing surface 132 of casing base 110. As shown in FIG. 4C, for example, circumferential groove 140 is located proximally of axial portion 136 and is defined in part by inner face 138. Axial portion 136 defines a region of reduced inner diameter ID relative to circumferential groove 140. In other embodiments, such as shown in FIG. 5, circumferential groove 140 is positioned between distal and proximal axial portions 136*a*, 136*b*, respectively.

Circumferential groove 140 has an inner diameter $ID_1$ that is greater than the inner diameter ID2 of axial portion 136. In some embodiments, circumferential groove 140 has a diameter that is from 65% to 92% of outer diameter D1 of casing base 110. In some embodiments, circumferential groove 140 has an axial height H1 that is from 5% to 25% of outer diameter D1. The particular diameter IDi and axial height H1 of circumferential groove 140 may depend on the type and caliber of ammunition, as will be appreciated. Circumferential groove 140 can have a profile with a semi-circular, rectangular, oval, C-shape, or other shape, or combination of shapes. In one example, circumferential groove 140 has axial height H1 of about 0.05" and inner diameter IDi of about 0.40", casing base 110 has an outer diameter D1 of about 0.47", and axial portion 136 has an inner diameter ID2 of about 0.34".

Figure 7:
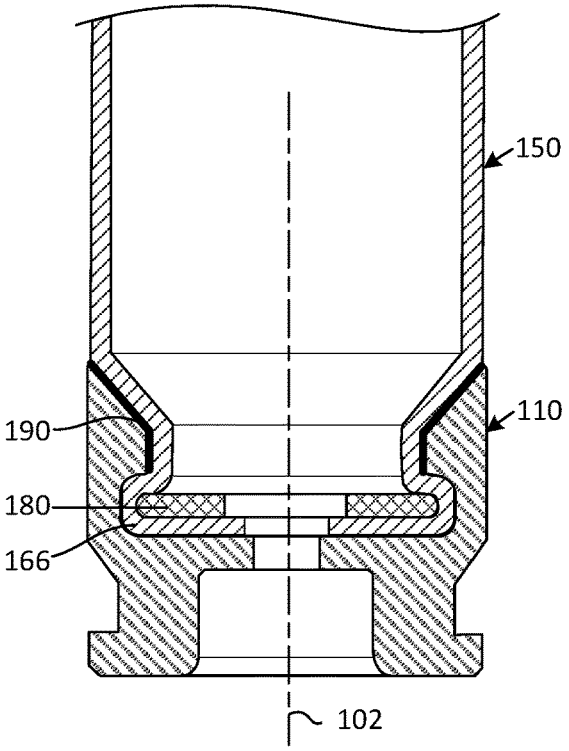
FIG. 7 is a cross-sectional view of a cartridge casing that includes a gasket between the casing body and the casing base, in accordance with an embodiment of the present disclosure.

Referring now to FIG. 7, a cross-sectional view illustrates cartridge casing 100 in accordance with another embodiment of the present disclosure. Here, cartridge casing 100 includes a gasket 190 disposed between casing body 150 and casing base 110. In some such embodiments, cartridge casing 100 may include or omit expansion washer 180. For example, gasket 190 is a coating (e.g., nitride coating), a layer of adhesive, or a thin body of metal or polymer material placed between or disposed on one or both of the mating surfaces of casing body 150 and casing base 110. Gasket 190 is useful to enhance the seal between casing body 150 and casing base 110 so as to prevent or reduce the likelihood of a gas leak between the components upon discharge of the completed ammunition cartridge in the firearm chamber. In some embodiments, gasket 190 can also reduce or prevent external galvanic corrosion by providing a waterproof seal between casing base 110 and casing body 150 in addition to eliminating water vapor that is needed for galvanic corrosion to occur. In one example, gasket 190 is a nitride coating or polymer coating on inner casing surface 132 of casing base 110 and/or on the outside surface of proximal end portion 160 of casing body 150. For example, gasket 190 is disposed on shoulder portion 134 prior to assembling casing body 150 with casing base 110. Gasket 190 can also be disposed along axial portion 136 in some embodiments. In some embodiments, the coating or annular body of material conforms during assembly to create a waterproof seal between casing base 110 and casing body 150.

In another example, gasket 190 is made of a ductile metal or polymer. For example, gasket 190 can be placed on shoulder portion 134 of casing base 110 prior to positioning casing body 150 in the opening 130. When casing base 110 and casing body 150 are assembled using a press or the like, gasket 190 can enhance or provide a gas-tight seal between the two components. In one example, gasket 190 is a body of non-conductive material (e.g., polyethylene) and has a frustoconical shape with a wall thickness from 0.008 to 0.010 inch prior to assembly of casing body 150 with casing base 110. In some instances, the geometry of the gasket 190 wall is consistent with that of the shoulder portion 134 of the casing base, such as defining an identical or substantially identical angle (±3°) with respect to the central axis 102. Gasket 190 is discussed further below with regard to a method 300 of making a cartridge casing. Numerous variations and configurations will be apparent in light of the present disclosure.

Figure 8A:
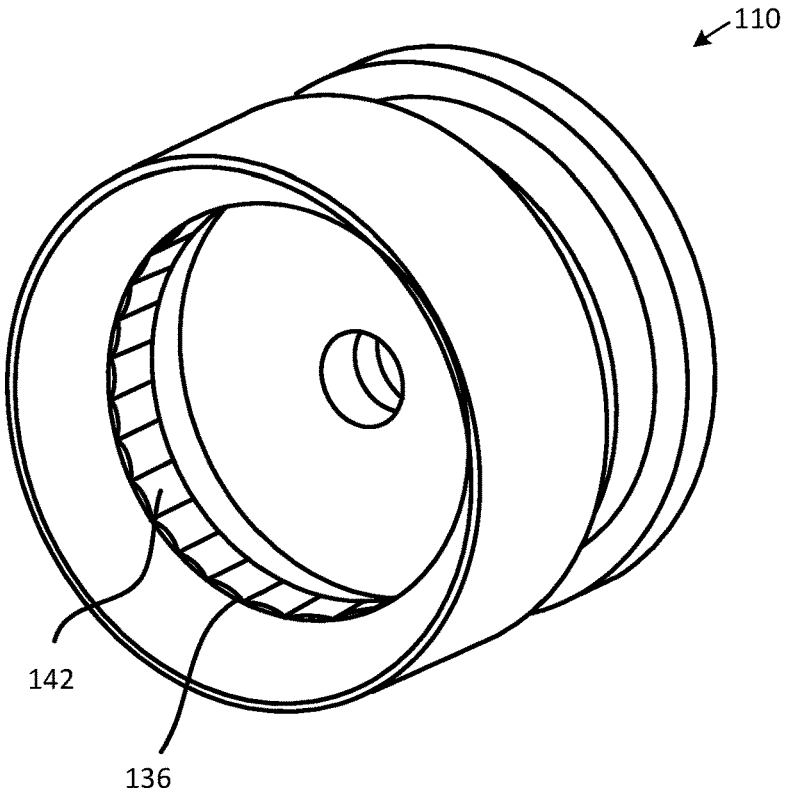
FIG. 8A is a perspective view of a casing base showing facets along an axial portion, in accordance with an embodiment of the present disclosure.
Figure 8B:
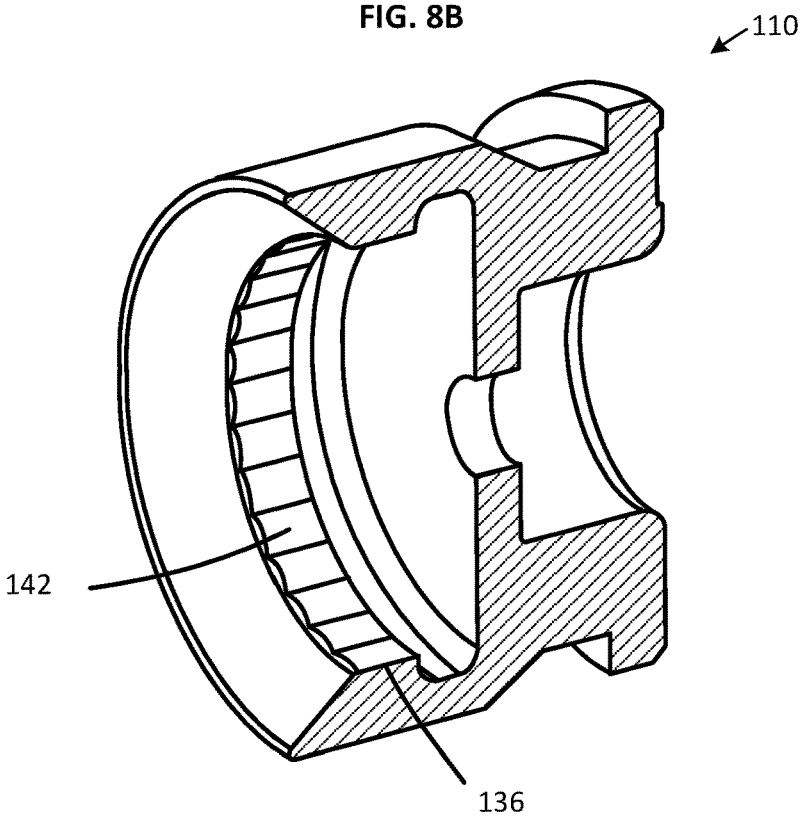
FIG. 8B is a perspective, cross-sectional view of the casing base of FIG. 8A.

Referring now to FIGS. 8A and 8B, a perspective view and a perspective cross-sectional view, respectively, illustrate a casing base 110, in accordance with an embodiment of the present disclosure. Axial portion 136 need not have a smooth or purely cylindrical geometry. For example, axial portion 136 can define a plurality of facets 142, each of which can be a flat, a spline, a serration, a cut, or some other geometry. Facets 142 may result in axial portion 136 having a non-round cross-sectional shape. In one example, the axial portion 136 defines a polygon with six, eight, ten, twelve, fourteen, sixteen, twenty, twenty-four, twenty-eight, or thirty-two sides. In another example, each facet defines a tetrahedon or cuspated geometry. In yet other embodiments, axial portion 136 can include a roughened surface texture in addition to or as an alternative to the facets 142. For example, axial portion includes knurling, grinding, machining, random defects, or other recess or protrusion. The surface roughness may result from machining, etching, blasting, or other suitable process. In yet another example, the surface of the axial portion 136 includes a coating or other surface treatment that provides increased surface roughness. As the casing body 150 expands during the manufacturing process, it engages and conforms to the facets and/or surface roughness for improved holding strength between casing base 110 and casing body 150.

Figure 9:
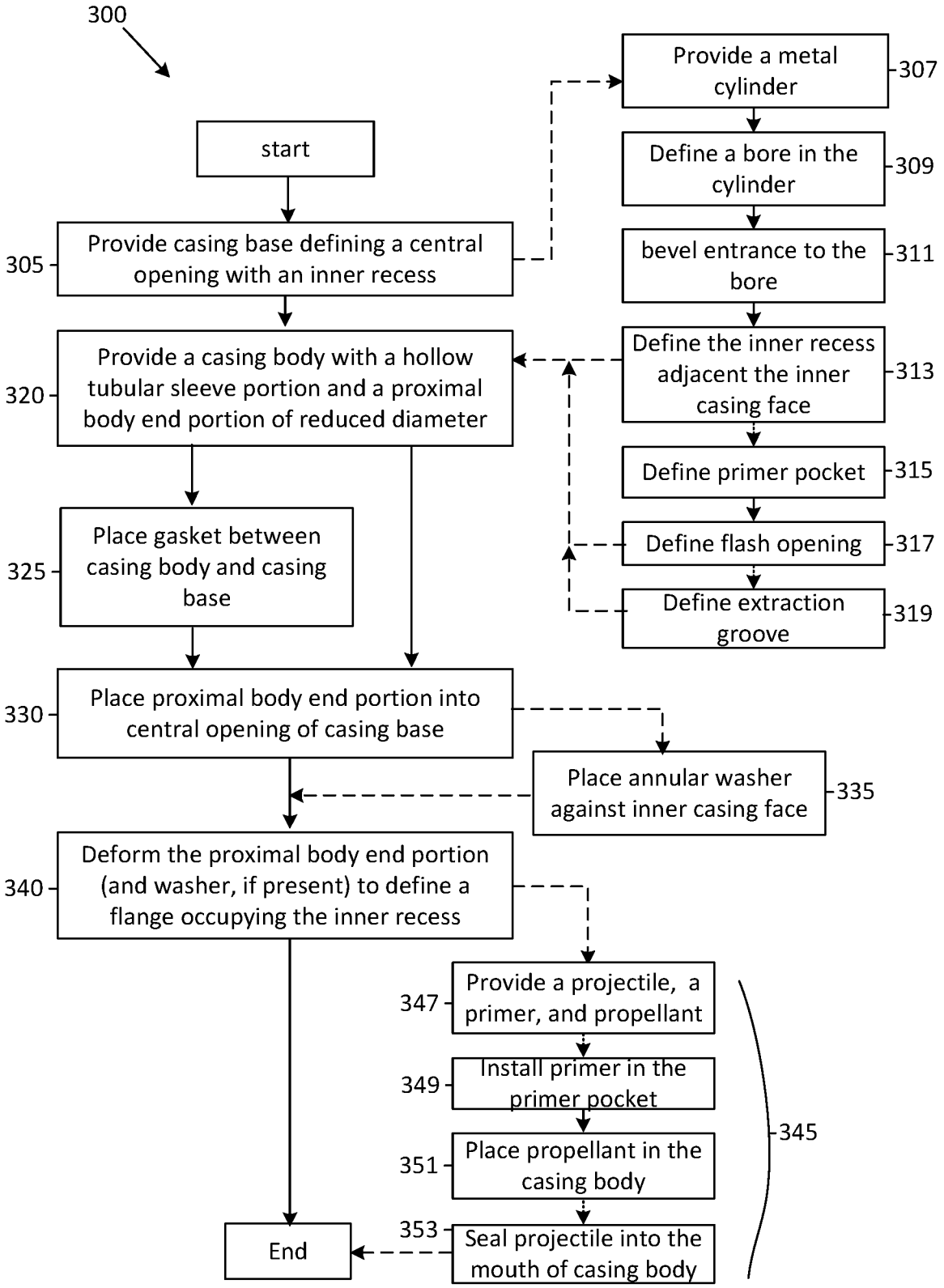
FIG. 9 is a flow chart illustrating steps in an example method of making a cartridge casing, in accordance with some embodiments of the present disclosure.

Referring now to FIG. 9, a flowchart illustrates example steps in a method 300 of making a cartridge casing in accordance with an embodiment of the present disclosure. Method 300 is not limited to the sequence of steps illustrated in FIG. 9 and various steps of method 300 may be performed in a different order, as will be appreciated. FIGS. 10-14 illustrate cartridge casing 100 in various stages of manufacturing, in accordance with some embodiments of the present disclosure.

Method 300 begins with providing 305 a casing base defining a central opening with an inner recess. In one example, the casing base is made of a metal and has a generally cylindrical shape extending along a central axis from a proximal base end to a distal base end. The central opening extends axially into the casing base from the distal base end to an inner casing face. The inner casing face is oriented generally perpendicularly to the central axis and defines an end (e.g., a blind end) of the opening. The inner recess is formed adjacent the inner casing face and has a recess diameter greater than a diameter of the opening distally adjacent the inner recess.

In some embodiments, providing 305 the casing base includes forming the casing base. In one embodiment of forming the casing base, a cylinder of the metal is provided 307, the cylinder extending along the central axis and having an outer diameter. A bore is defined 309 in the cylinder, the bore extending axially into the cylinder part way from the distal base end to the inner casing face. For example, the bore is a blind bore that terminates at the inner casing face. The entrance to the bore is beveled 311 at the distal base end and the inner recess is defined 313 adjacent the inner casing face. In one example, forming the casing base can be performed using a cold forming die, by machining, or other suitable process.

In some embodiments, forming the casing base also includes defining 315 the primer pocket in the proximal end of the casing base and defining 317 a flash opening that extends between and connects the primer pocket and the opening in the distal base end. In some embodiments, an extraction groove is defined 319 in the outside of the casing base.

Method 300 continues with providing 320 a casing body preform made of a second material, the casing body preform having a hollow tubular sleeve portion extending along the central axis between a distal body end portion and a proximal body end portion of a reduced diameter. The casing body preform also defines a propellant chamber and an open mouth. The second material can be the same as or different from the metal of the casing base.

Figure 10A:
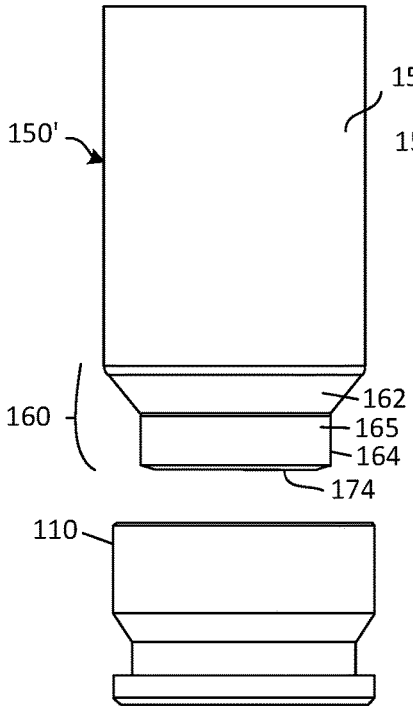
FIG. 10A is an elevational view showing a cartridge body preform and a cartridge base ready for assembly, in accordance with an embodiment of the present disclosure.

FIG. 10A illustrates an elevational view of a casing base 110 and a casing body preform 150' as separate components ready for assembly, in accordance with one embodiment of the present disclosure. Proximal end portion 160 of casing body preform 150' has a reduced diameter compared to sleeve portion 152. In some embodiments, proximal end portion 160 has a sleeve shoulder 162 and cup portion 165. Cup portion 165 includes axial sidewalls 164 and closed proximal body wall 174 at its base that extends between ends of axial sidewalls 164. In some embodiments, proximal end portion 160 of casing body preform 150' is consistent in its shape with at least part of the opening 130 in the casing base 110.

Figure 10B:
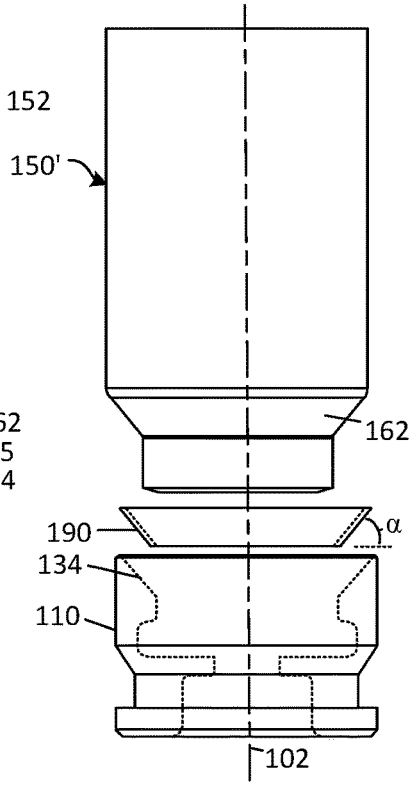
FIG. 10B is an elevational view showing a cartridge body preform, a gasket, and a cartridge base ready for assembly, in accordance with an embodiment of the present disclosure.

Method 300 optionally continues with placing 325 a gasket between the proximal end portion of the casing body preform and the opening in the casing base. Examples of gasket 190 are discussed above. FIG. 10B illustrates an elevational view of a casing base 110, casing body preform 150', and a seal or gasket 190 ready for assembly, in accordance with an embodiment of the present disclosure. The gasket may be comprised of a material that is of greater malleability or plasticity than is the material of the casing base or the proximal body. For example, the gasket 190 is made of polyethylene or other non-conducting material and has an annular body with a frustoconical profile. For example, the gasket 190 has a wall thickness from 0.008 to 0.010 inch and defines an angle a with respect to the horizontal or with respect to central axis 102 that is the same or substantially the same as that for shoulder portion 134 of the casing base 110. The gasket 190 can be dropped or otherwise placed in contact with the shoulder portion 134 of the casing base 110, followed by inserting the casing body preform 150' into the mouth 158 of the casing base 110. As the material of the casing body preform 150' is drawn against the casing base 110, the gasket 190 creates a waterproof seal while eliminating the external water vapor needed for galvanic corrosion to occur.

Figure 11:
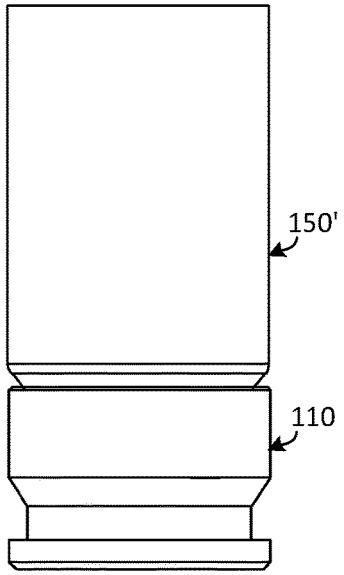
FIG. 11 is an elevational view showing the proximal end portion of the cartridge body preform installed into the opening of the casing base, in accordance with an embodiment of the present disclosure.

Method 300 of FIG. 9 continues with placing 330 the proximal body end portion of the casing body preform into the opening of the casing base. FIG. 11 illustrates an example of casing body preform 150' placed in opening 130 of casing base 110. Proximal body wall 174 (shown in FIG. 13) of casing body preform 150' contacts inner casing face 138 of casing base 110. At this stage of method 300, proximal end portion 160 has not yet been shaped to define flange 166 or to form a seal with inner casing surface 132. Accordingly, casing body preform 150' is not seated in casing base 110 and a gap exists between sleeve shoulder 162 and shoulder portion 134 of casing base 110.

Figure 12:
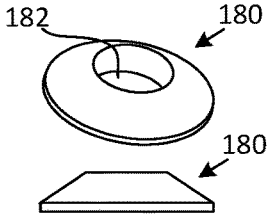
FIG. 12 illustrates a perspective view and a side elevational view of a washer, in accordance with an embodiment of the present disclosure.

Method 300 continues in some embodiments with placing 335 an annular washer against the inside face of proximal body wall of the casing body preform. Placing 335 the annular washer can be performed before or after placing 330 the proximal body end portion into the opening of the casing base. FIG. 12 illustrates a top perspective view and an elevational view of one embodiment of washer 180. Washer 180 has a generally frustoconical shape and defines a centrally located through opening 182. Other geometries are acceptable, including a cylinder and a loop. In some embodiments, washer 180 has an axial height at least as great as axial height H1 of the circumferential groove 140, which is also referred to as the inner recess. In some embodiments, the washer is made of ABS plastic, acetal, low density polyethylene, high density polyethylene, high-impact polystyrene, nylon, polycarbonate, polypropylene, polyetherimide, aluminum, aluminum alloy, copper, a copper alloy, brass, or gilding metal.

Figure 13:
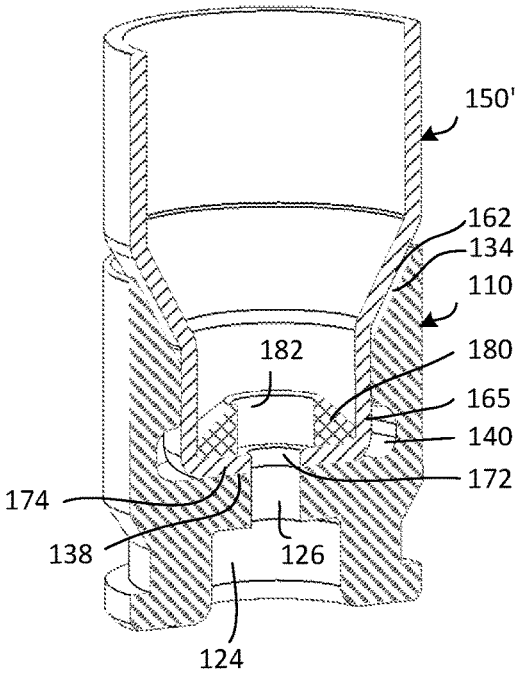
FIG. 13 illustrates a cross-sectional view of a casing body preform, a washer, and a casing base ready to be deformed and secured together in an assembled cartridge casing, in accordance with an embodiment of the present disclosure.

Referring now to FIG. 13, a perspective, cross-sectional view shows an example of casing body preform 150' with proximal end portion 160 placed in central opening 130 of casing base 110. Proximal body wall 174 contacts inner casing face 132 with central opening 172 aligned over flash opening 126. Annular washer 180 is placed on the inside face of proximal body wall 174. Through opening 182 of washer 180 is aligned over flash opening 126 (or its intended location). A gap exists between shoulder portion of casing base 110 and sleeve shoulder 162 of casing body preform 150'.

In some embodiments of method 300, flash opening 126 and central opening 172 through proximal body wall 174 may or may not be defined prior to deforming the proximal body end portion 160 to define the flange 166. In some embodiments, it may be desirable to drill, punch, or otherwise form flash opening 126 and central opening 172 prior to assembly, such as when central opening 172 is larger than flash opening 126. In other embodiments, it may be desirable to define flash opening 126 and central opening 172 after assembling casing body 150 with casing base 110, such as when central opening 172 will have the same size as flash opening 126. Suitable variations will be apparent in light of the present disclosure.

Method 300 of FIG. 9 continues with deforming 340 the proximal body end portion to extend radially outward, thereby defining a flange that occupies and conforms to the inner recess of the casing base. Deforming 340 the proximal body end portion forms the casing body preform into the casing body. The deforming 340 step secures the casing body to the casing base.

Figure 14:
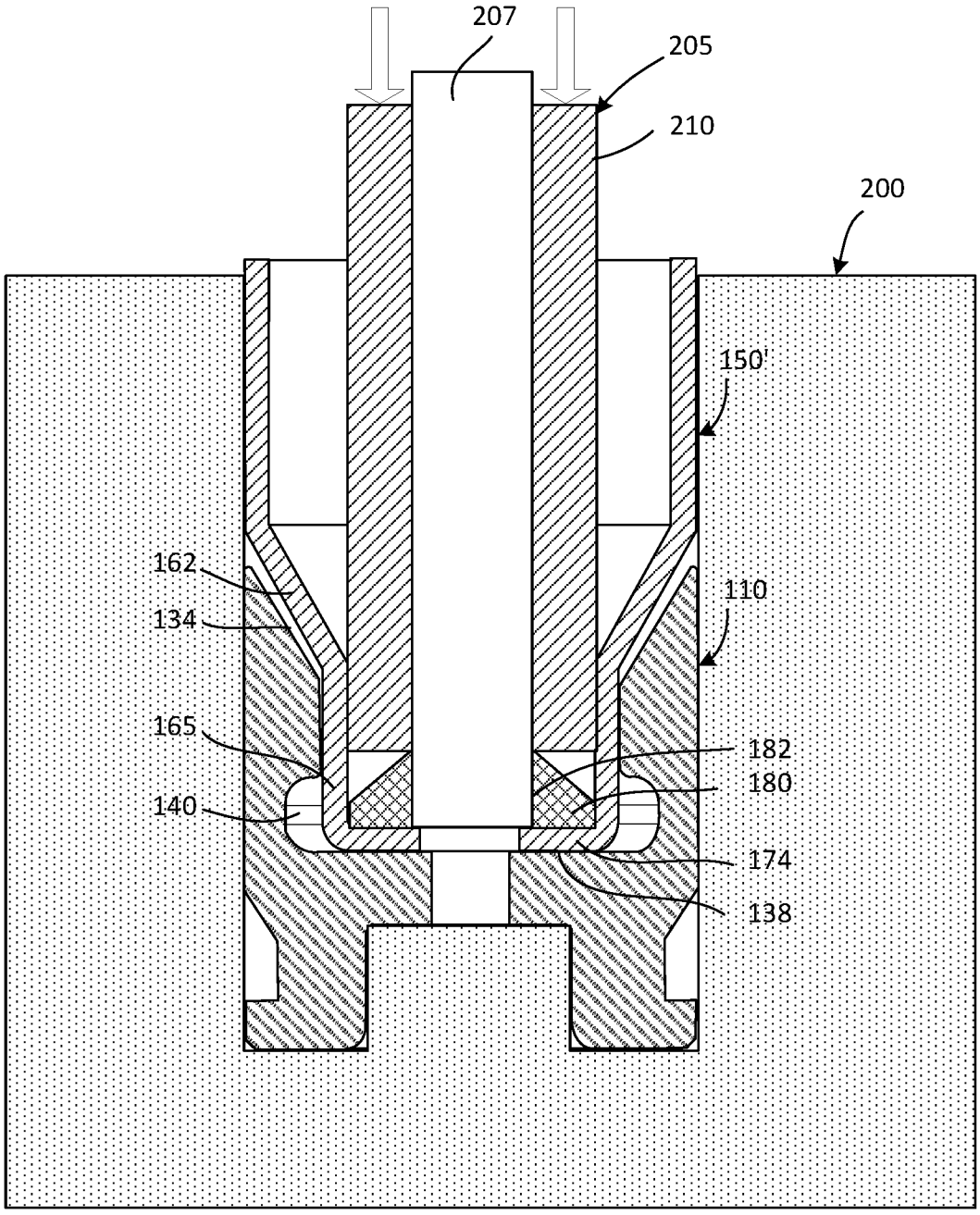
FIG. 14 illustrates a cross-sectional view of the casing body preform, washer, and casing base of FIG. 13 disposed in a die, in accordance with an embodiment of the present disclosure.

FIG. 14 illustrates an elevational cross-sectional view of a cold forming die 200 containing casing base 110, casing body preform 150', and washer 180 prior to the deforming 340 step. A punch 205 includes a central rod 207 and an outer cylindrical ram 210. Central rod 207 extends into the through opening 182 of washer 180 and in contact with proximal body wall 174, which is structurally supported by die 200 and casing base 110. As the ram 210 moves axially, it compresses washer 180 and forces cup portion 165 to extend radially outward and conform to the inner recess (structured as circumferential groove 140) in casing base 110. During this compression, sleeve shoulder 162 will move axially to mate with shoulder portion 134 of casing base 110. In some embodiments, the result of the deforming 340 step is a cartridge casing 100 that includes the casing base 110, casing body 150, and washer 180 (when present) that is ready to load with a primer, propellant, and a projectile. In other embodiments of method 300, additional subsequent processing may be performed, such as defining the primer pocket 124 and flash opening 126, for example.

In some embodiments, method 300 of FIG. 9 optionally continues with loading 345 the assembled cartridge casing. In one example, loading 345 includes providing 347 a projectile, a primer, and a quantity of propellant; installing 349 the primer in the primer pocket; placing 351 the quantity of propellant in the casing body, and sealing 353 the projectile into the mouth of the casing body. Loading 345 the cartridge casing may be performed using established techniques, as will be appreciated.

Figure 15:
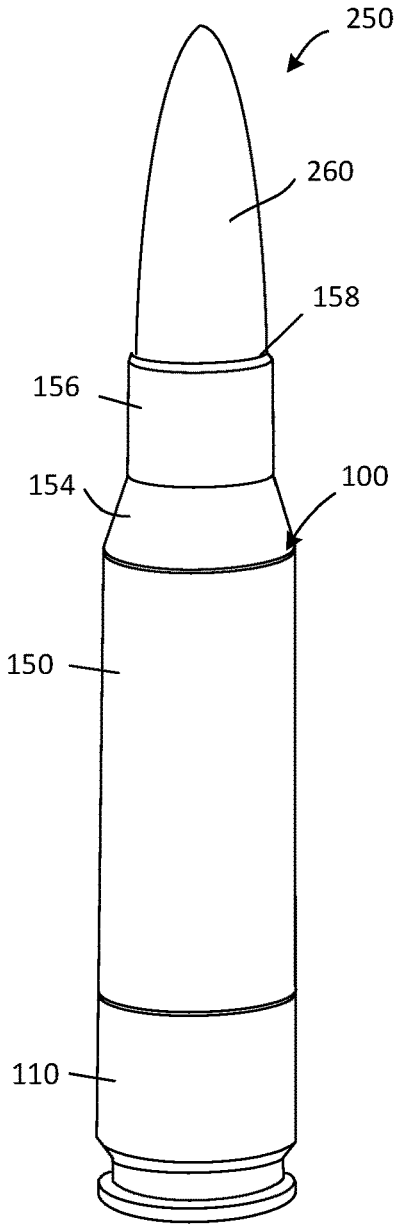
FIG. 15 illustrates an example of a rifle ammunition cartridge that includes a multi-piece cartridge casing, in accordance with an embodiment of the present disclosure.
Figure 17:
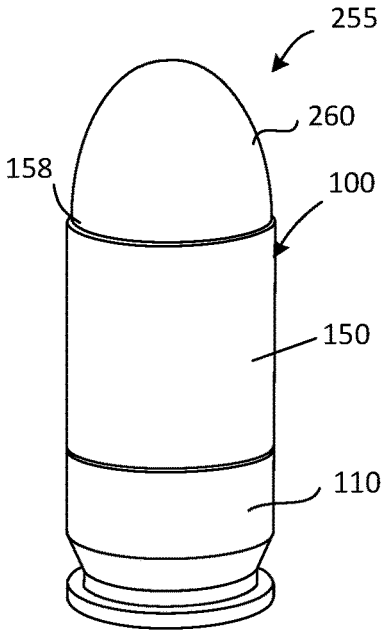
FIG. 17 illustrates an example of a pistol ammunition cartridge that includes a multi-piece cartridge casing, in accordance with an embodiment of the present disclosure.
Figure 16:
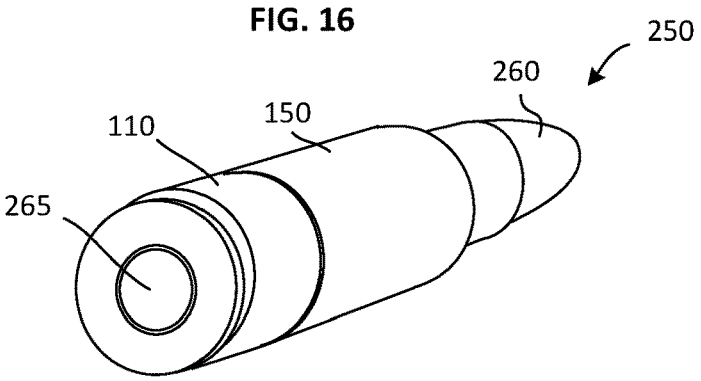
FIG. 16 illustrates an end perspective view of the ammunition cartridge of FIG. 15 showing a primer disposed in the casing head, in accordance with an embodiment of the present disclosure.

Referring now to FIGS. 15-17, example embodiments are shown of firearm ammunition that include cartridge casings 100 of the present disclosure. FIG. 15 illustrates an elevational view of a rifle cartridge 250 that includes cartridge casing 100 with casing base 110 and casing body 150. Cartridge casing 100 includes a neck portion 156 and a sleeve portion 152. A projectile 260 is sealed in the mouth 158 of the casing body 150. FIG. 16 illustrates a proximal-end perspective view of rifle cartridge 250 showing a primer 265 installed in casing head 110. FIG. 17 illustrates an elevational view of a pistol cartridge 255 utilizing cartridge casing 100 that includes casing base 110 and casing body 150. A projectile 260 is sealed in the mouth 158 of the casing body 150.

Casing base 110 can be made of a variety of suitable metals, including C260 cartridge brass, yellow brass, nickel brass, admiralty brass, other brass compositions, mild steel, stainless steel, titanium, titanium alloys, and aluminum alloys, to name a few examples. In some embodiments, any one or more of the components of the cartridge can include a coating, plating, or other surface treatment. Examples of some such surface treatments include nickel plating, manganese phosphate coating, ceramic coatings (e.g., Cerakote®), black oxide coating, or molybdenum disulfide ($MoS_2$) coating, to name a few examples. In embodiments that include steel or other metal susceptible to corrosion, the steel may include a polymer or other coating to inhibit corrosion. Table 1 below lists the weight percentage of elements in four example compositions of aluminum alloy. Table 2 below lists the weight percentage of elements in five example compositions of titanium alloy. Many other alloy compositions are acceptable, as will be appreciated.

TABLE 1

Aluminum alloy compositions

| Element | Alloy 2011 | Alloy 2024 | Alloy 7075 | Alloy 7068 |
|---|---|---|---|---|
| Silicon | 0.40 | 0.50 | 0.40 | 0-0.12 |
| Iron | 0.70 | 0.50 | 0.50 | 0-0.15 |
| copper | 5.0-6.0 | 3.80-4.90 | 1.20-2.00 | 1.6-2.4 |
| Lead | 0.2-0.4 | | | |
| Bismuth | 0.2-0.6 | | | |
| Manganese | | 0.30-0.90 | 0.30 | 0-0.10 |
| Magnesium | | 1.20-1.80 | 2.10-2.90 | 2.2-3.0 |
| Chromium | | 0.10 | 0.18-0.28 | 0-0.05 |
| Zinc | 0.30 | 0.25 | 5.10-6.10 | 7.3-8.3 |
| Titanium | | 0.15 | 0.20 | 0-0.10 |
| Other | 0-0.05 each | 0-0.05 each | 0-0.05 | 0-0.05 |
| Aluminum | 91.55 | 90.70 | 87.12 | 85.43 |

TABLE 2

Titanium alloy compositions

| Element | A | B | C | D | E |
|---|---|---|---|---|---|
| Nitrogen | 0.05 | 0.03 | 0.02 | 0.03 | 0.03 |
| Carbon | 0.1 | 0.1 | 0.05 | 0.08 | 0.08 |
| Hydrogen | 0.0125 | 0.015 | 0.013 | 0.015 | 0.0125 |
| Iron | 0.4 | 0.3 | 0.25 | 0.3 | 0.25 |
| Oxygen | 0.2 | 0.25 | 0.12 | 0.25 | 0.13 |
| Palladium | — | 0.25 | — | — | — |
| Aluminum | 6.75 | — | 3.5 | — | 6.5 |
| Molybdenum | — | — | — | 0.4 | — |
| Vanadium | 4.5 | — | 3 | — | 4.5 |
| Nickel | — | — | — | 0.9 | — |
| Titanium | 87.9875 | 99.055 | 93.047 | 98.025 | 88.4975 |

Casing body 150 can be made of a variety of suitable metals. Examples of acceptable metals include various brass compositions, mild steel, stainless steel, titanium, titanium alloys, and aluminum alloys. In some embodiments, casing body 150 comprises a material that is softer and/or more ductile than the material of casing base 110, although this is not required.

Materials of a given cartridge casing 100 may be selected based on the desired tensile strength, desired yield strength, density/mass of the cartridge casing, and cost. Material selection may also contribute to or be dictated by manufacturing tolerances, the precision in performance demanded by the end user, and acceptable amounts of carbon deposits resulting from repeated firing. Such considerations may be different depending on whether the completed ammunition cartridge is intended for military use, match target shooting, plinking, hunting, defense, or other use. Material selections may also be based in part on the type of cartridge to be produced and the pressure generated within cartridge casing 110, whether large-caliber ammunition (e.g., .50 BMG, 20 mm, 30 mm), rifle ammunition (e.g., 5.56×45, 7.62×51), or pistol ammunition (e.g., .45 Auto, 9×19 mm Luger, .380 Auto). Further, a cartridge casing 100 can be configured for use with metal machine gun links or other feeding devices, such as for use with belt-fed machine guns.

In some embodiments, cartridge casing 100 has an ultimate tensile strength of at least 50,000 psi. For example, cartridge casing 100 configured for rifle ammunition is configured for standard pressures up to about 62,000 psi. In other embodiments, cartridge casing 100 has an ultimate tensile strength of at least 62,000 psi, including at least 70,000 psi, at least 75,000 psi, at least 80,000 psi, at least 90,000 psi, at least 100,000 psi, at least 110,000 psi, at least 120,000 psi, or greater.

In other embodiments, cartridge casing 100 is configured for pistol ammunition, which generally has an operating pressure of 40,000 psi or less. Accordingly, in some embodiments configured for pistol ammunition, cartridge casing 100 has an ultimate tensile strength of at least 30,000 psi, including at least 35,000 psi, at least 40,000 psi, at least 50,000 psi, at least 60,000 psi, or greater. Cartridge casing 100 is not limited to these examples and other tensile strength requirements will be apparent in light of the present disclosure.

In some embodiments, the cartridge casing 100 is comprised of a casing base 110 and a casing body 150 where the casing base 110 is comprised of a first material and the casing body 150 is comprised of a second material that is different from the first material. The first material can have a tensile strength that is at least 10%, 50% or 100% greater than tensile strength of the second material. In other embodiments, the second material can have a tensile strength that is at least 10%, 50% or 100% greater than tensile strength of the first material. In the same and other embodiments, the first material can have a density that is at least 5%, 10%, 20%, 50% or 100% greater than the density of the second material. In other embodiments, the second material can have a density that is at least 5%, 10%, 20%, 50% or 100% greater than the density of the first material. In some embodiments, the first material is a metal or metal alloy and the second material is a different metal or metal alloy.

In one example, cartridge casing 100 includes a casing base 110 of aluminum alloy and a casing body 150 of titanium alloy. In one particular embodiment, the casing base is aluminum alloy 7075 or alloy 7068 and the casing body 150 is titanium alloy A as identified in table 2 above. Such an embodiment has an advantage of being very light weight compared to cartridge brass and a tensile strength far exceeding 62,000 psi.

In a second example, cartridge casing 100 includes a casing base 110 of mild steel and a casing body 150 of brass. Such an embodiment has an advantage of being less expensive and providing a slight reduction in weight compared to cartridge brass.

In a third example, cartridge casing 100 includes a casing base 110 of brass and a casing body 150 of aluminum alloy. Such an embodiment has an advantage of providing a significant weight reduction compared to cartridge brass and a tensile strength of at least 62,000 psi.

In a fourth example, cartridge casing 100 includes a casing base 110 of stainless steel and a casing body 150 of mild steel. Such an embodiment has an advantage of providing a slight reduction in weight compared to cartridge brass and a tensile strength above 62,000 psi.

In a fifth example, cartridge casing 100 includes a casing base 110 of titanium alloy and a casing body 150 of aluminum alloy. Such an embodiment has an advantage of being very light weight compared to cartridge brass and a tensile strength of at least 62,000 psi.

The materials selected for casing base 110, casing body 150, and expansion member 180 (when present) can be chosen based on the desired physical properties and/or the cost of cartridge casing 100 and the finished ammunition product. Physical properties include yield strength, tensile strength, stiffness, hardness, cold workability, hot workability, and corrosion resistance to name a few examples. In some embodiments, the yield strength of casing base 110 is from 40,000 psi to 120,000 psi. For example, the yield strength of casing base 110 is selected so that casing base 110 is not undesirably deformed in a cold forming die (e.g., at the rim 120 or primer pocket 124) during axial compression of washer 180.

Further Example Embodiments

The following examples pertain to further embodiments, from which numerous permutations and configurations will be apparent.

Example 1 is an ammunition cartridge casing comprising a casing base extending along a central axis from a casing head to a distal base end, the casing base having a generally cylindrical outer surface with an outer case diameter and an inner casing surface defining an opening extending axially into the casing base from the distal base end, wherein the inner casing surface has a shoulder portion extending radially inward and proximally from the distal base end, an axial portion extending proximally from the shoulder portion towards an inner face, and a circumferential groove located proximally of at least a portion of the axial portion and having a groove radius greater than a radius of the axial portion; and a casing body secured to the casing base, the casing body having a tubular sleeve portion extending along the central axis from a proximal sleeve end to a distal sleeve end, a proximal body portion connected to the proximal sleeve end and including (i) a sleeve shoulder extending along the shoulder portion of the casing base, (ii) an axial sidewall extending along the axial portion of the casing base, (iii) a flange protruding radially outward from the axial sidewall and mating with the circumferential groove, and (iv) a proximal body wall extending along the inner face and extending generally perpendicularly to the central axis across opposite sides of the proximal end portion, the proximal body wall defining a central opening.

Example 2 includes the subject matter of Example 1, wherein the flange includes a proximal flange portion and a distal flange portion each extending radially outward in an axially spaced-apart orientation with respective outer radial end portions connected by an axial flange sidewall, and wherein the flange defines a locking chamber between the proximal flange portion and the distal flange portion.

Example 3 includes the subject matter of Example 2 and further comprises an annular washer disposed at least partially in the locking chamber.

Example 4 includes the subject matter of Example 3, wherein the annular washer has a Shore hardness from D55 to D86 or a Brinell harness from B30 to B101.

Example 5 includes the subject matter of Examples 3 or 4, wherein the annular washer is made of a material selected from ABS plastic, acetal, low density polyethylene, high density polyethylene, high-impact polystyrene, nylon, polycarbonate, polypropylene, polyetherimide, aluminum, aluminum alloy, copper, a copper alloy, brass, and gilding metal.

Example 6 includes the subject matter of any of Examples 2-5, wherein the proximal flange portion extends along the proximal body wall.

Example 7 includes the subject matter of any of Examples 1-6, wherein the casing head defines a centrally located primer pocket extending axially into the casing base, wherein the opening is axially spaced from the centrally located primer pocket by a portion of the casing base defining a flash opening between the primer pocket and the casing body.

Example 8 includes the subject matter of Example 7, wherein the central opening in the proximal body wall of the casing body has a diameter at least as large as a diameter of the flash opening.

Example 9 includes the subject matter of any of Examples 1-8 and further comprises a gasket disposed between the shoulder portion of the casing base and the sleeve shoulder of the casing body, the gasket comprising a non-conducting material.

Example 10 includes the subject matter of any of Examples 1-9, wherein the axial portion defines a plurality of facets.

Example 11 includes the subject matter of any of Examples 1-9, wherein the axial portion defines a plurality of features selected from a flat, a spline, a cusp, a groove, a recess, or a serration.

Example 12 includes the subject matter of any of Examples 1-11 and further comprises a surface finish on the axial portion, the surface finish providing increased surface roughness.

Example 13 includes the subject matter of any of Examples 1-12, wherein the circumferential groove extends uninterrupted 360° about the central axis.

Example 14 includes the subject matter of any of Examples 1-13, wherein the casing base and the casing body each comprises a metal.

Example 15 includes the subject matter of Example 14, wherein the metal comprises one or more of copper, zinc, nickel, tin, aluminum, lead, and iron.

Example 16 includes the subject matter of any of Examples 1-15, wherein the casing base is compositionally distinct from the casing body.

Example 17 includes the subject matter of any of Examples 14-16, wherein the metal is selected from brass, mild steel, stainless steel, aluminum alloy, titanium, and titanium alloy.

Example 18 includes the subject matter of Example 17, wherein the brass is one of C260 cartridge brass, nickel brass, or naval brass.

Example 19 includes the subject matter of any of Examples 14-16, wherein at least one of the casing base and the casing body is made of aluminum alloy 7075 or aluminum alloy 7068.

Example 20 includes the subject matter of Example 1-19, wherein the cartridge casing has an ultimate tensile strength of at least 70,000 psi.

Example 21 includes the subject matter of Example 20, wherein the ultimate tensile strength is at least 80,000 psi.

Example 22 includes the subject matter of Example 20, wherein the ultimate tensile strength is at least 100,000 psi.

Example 23 includes the subject matter of Example 20, wherein the ultimate tensile strength is at least 120,000 psi.

Example 24 includes the subject matter of Example 1-23, wherein a distal end portion of the casing body defines a casing shoulder and a neck portion.

Example 25 includes the subject matter of Example 1-24, wherein the casing base defines one or more of a rim and an extraction groove.

Example 26 includes the subject matter of Example 1-25, wherein the ammunition cartridge casing is configured for centerfire ammunition.

Example 27 includes the subject matter of Example 1-26, wherein the ammunition cartridge casing is configured for a rifle ammunition or a pistol ammunition.

Example 28 includes the subject matter of Example 1-27 and further comprises a projectile retained in a mouth of the casing body; a primer disposed in the primer pocket; and a quantity of propellant disposed the casing body between the projectile and the primer.

Example 29 is a cartridge casing comprising a casing base extending along a central axis from a casing head to a distal base end, the casing base having an inside surface defining (i) a primer pocket in the casing head, the primer pocket having a first diameter, (ii) an open region situated distally of the primer pocket, the open region having a distal portion with a second diameter and a proximal portion with a third diameter greater than the second diameter, and (iii) an annular wall between the primer pocket and the open region, the annular wall having a distal face and defining a flash opening between the primer pocket and the proximal portion of the open region, the flash opening having an opening diameter smaller than the first diameter and smaller than the third diameter; and a casing body secured to the casing base, the casing body having a tubular sleeve portion extending distally from the casing base and having a proximal body portion disposed in the open region of the casing base, wherein the proximal body portion extends along and mates with the inside surface of the open region and a distal face of the annular wall.

Example 30 includes the subject matter of Example 29 and further comprises an annular washer within the proximal body portion along the distal face, the annular washer having an outer diameter greater than the second diameter and spaced from the distal face of the annular wall by a portion of the proximal body portion of the casing body.

Example 31 includes the subject matter of any of Examples 29-30, wherein the inside surface of the casing base defines a plurality of facets along the distal portion of the open region.

Example 32 includes the subject matter of any of Examples 29-31, wherein the casing base comprises a metal and the casing body is compositionally distinct from the metal.

Example 33 includes the subject matter of any of Examples 29-32, wherein the casing base comprises a first material and the casing body comprises a second material different from the first material.

Example 34 includes the subject matter of Example 33, wherein the second material is different from the first material in at least one of a density and a tensile strength.

Example 35 includes the subject matter of any of Examples 29-34, wherein the cartridge casing has an ultimate tensile strength of at least 70,000 psi.

Example 36 includes the subject matter of any of Examples 29-34, wherein the cartridge casing has an ultimate tensile strength of at least 80,000 psi.

Example 37 includes the subject matter of any of Examples 29-34, wherein the cartridge casing has an ultimate tensile strength of at least 100,000 psi.

Example 38 includes the subject matter of any of Examples 29-34, wherein the cartridge casing has an ultimate tensile strength of at least 120,000 psi.

Example 39 is an ammunition cartridge comprising the cartridge casing of any of Examples 29-36; a projectile retained in a mouth of the casing body; a primer disposed in the primer pocket; and a quantity of propellant disposed the casing body between the projectile and the primer.

Example 40 includes the subject matter of any of Examples 29-39, wherein the ammunition cartridge casing is configured for a rifle ammunition or a pistol ammunition.

Example 41 is a method of making an ammunition cartridge casing, the method comprising providing a casing base made of a first metal and having a generally cylindrical shape extending along a central axis from a proximal base end to a distal base end, the casing base defining an opening extending axially into the casing base from the distal base end to an inner casing face, the opening including an inner recess adjacent the inner casing face, the inner recess having a recess diameter greater than a diameter of a portion of the opening distally adjacent the inner recess; providing a casing body preform made of a second metal, the casing body preform having a hollow tubular sleeve portion extending along the central axis, and a proximal body end portion with a sleeve shoulder extending from the hollow tubular sleeve portion to a cup portion of reduced diameter, the cup portion having a generally cylindrical sidewall extending axially to a proximal body wall; placing the proximal body end portion in the opening of the casing base with the proximal body wall in contact with the inner casing face; and deforming the proximal body end portion to extend radially outward, thereby defining a flange that mates with the inner recess of the casing base.

Example 42 includes the subject matter of Example 41, wherein the cartridge casing has an ultimate tensile strength of at least 70,000 psi.

Example 43 includes the subject matter of Example 41, wherein providing the casing base includes providing a cylinder of the metal extending along the central axis, the cylinder having an outer diameter; defining a blind bore extending axially into the cylinder part way from the distal base end to the inner casing face; beveling an entrance to the blind bore from the distal base end; and defining the inner recess adjacent inner casing face.

Example 43 includes the subject matter of any of Examples 41-43 and further comprises defining a primer pocket extending axially into the cylinder from the proximal base end; and defining a flash opening extending axially between the primer pocket and the opening in the casing base.

Example 45 includes the subject matter of any of Examples 41-44 and further comprises defining an extraction groove in an outside surface of the casing base.

Example 46 includes the subject matter of any of Examples 41-45 and further comprises placing an annular washer against an inside of the proximal body wall, wherein deforming the proximal body end portion includes compressing the annular washer axially, thereby causing the annular washer to deform radially outward and into the flange.

Example 47 includes the subject matter of Example 46, wherein the annular washer comprises a material selected from ABS plastic, acetal, low density polyethylene, high density polyethylene, high-impact polystyrene, nylon, polycarbonate, polypropylene, polyetherimide, aluminum, aluminum alloy, copper, a copper alloy, brass, and gilding metal.

Example 48 includes the subject matter of any of Example 41-47 and further comprises placing a gasket between the casing shoulder of the casing body preform and the shoulder portion of the casing base, the gasket comprising a non-conductive material.

Example 49 includes the subject matter of any of Examples 41-48, wherein the casing body is compositionally distinct from the casing base.

Example 50 includes the subject matter of any of Examples 41-47, wherein the second metal is the same as the first metal.

Example 51 includes the subject matter of any of Examples 41-47, wherein the first metal and the second metal each comprises one of brass, stainless steel, mild steel, titanium, titanium alloy, and aluminum alloy.

Example 52 includes the subject matter of any of Examples 41-51, wherein providing the casing body includes selecting the casing body to include a casing shoulder extending distally from the hollow tubular sleeve portion and a neck extending distally from the casing shoulder, the neck defining the open mouth.

Example 53 includes the subject matter of any of Examples 41-52 further comprising providing a projectile, a quantity of propellant, and a primer; installing the primer in the primer pocket; disposing the quantity of propellant in the propellant chamber; and sealing the open mouth of the casing body around the projectile.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. An ammunition cartridge casing comprising:

a casing base of a first metal, the casing base extending along a central axis from a proximal base end to a distal base end, the casing base having a generally cylindrical outer surface with an outer case diameter, and an inner casing surface defining an open region extending axially into the casing base from the distal base end to a distal inner face, wherein the inner casing surface has a shoulder portion extending radially inward and proximally from the distal base end, an axial portion extending proximally from the shoulder portion towards the distal inner face, and a circumferential groove between the distal inner face and the axial portion, wherein the circumferential groove has a groove radius greater than a radius of the axial portion, and wherein the casing base defines a primer pocket between the proximal base end and the distal inner face, the primer pocket in communication with the open region via a flash opening in the distal inner face; and a casing body of a second metal, the casing body secured to the casing base and having a tubular sleeve portion extending along the central axis from a proximal sleeve end to a distal sleeve end, a proximal body portion connected to the proximal sleeve end and including (i) a sleeve shoulder extending along the shoulder portion of the casing base, (ii) an axial sidewall extending along the axial portion of the casing base, (iii) a flange protruding radially outward from the axial sidewall and mating with the circumferential groove, and (iv) a proximal body wall engaging and extending radially inward along the distal inner face of the casing base, the proximal body wall defining a wall opening around the flash opening.

2. The ammunition cartridge casing of claim 1 further comprising a gasket disposed between the shoulder portion of the casing base and the sleeve shoulder of the casing body, the gasket comprising a non-conducting material.

3. The ammunition cartridge casing of claim 1, wherein the inner surface of the axial portion of the casing base defines a plurality of facets.

4. The ammunition cartridge of claim 1, wherein the axial portion of the inner casing surface defines one or more features selected from a flat, a spline, a cusp, a groove, a recess, and a serration.

5. The ammunition cartridge casing of claim 1, wherein the inner casing surface of the casing base has an increased surface roughness compared to the outer surface.

6. The ammunition cartridge casing of claim 1, wherein the first metal and the second metal are selected from brass, mild steel, stainless steel, aluminum alloy, titanium, and titanium alloy, and wherein the casing base is compositionally distinct from the casing body.

7. The ammunition cartridge casing of claim 1, wherein at least one of the first metal and the second metal is aluminum alloy 7075 or aluminum alloy 7068.

8. The ammunition cartridge casing of claim 1, wherein the cartridge casing has an ultimate tensile strength of at least 70,000 psi.

9. The ammunition cartridge casing of claim 8, wherein the ultimate tensile strength is at least 100,000 psi.

10. An ammunition cartridge casing comprising:

a casing base extending along a central axis from a casing head to a distal base end, the casing base having a generally cylindrical outer surface with an outer case diameter, and an inner casing surface defining an open region extending axially into the casing base from the distal base end, wherein the inner casing surface has a shoulder portion extending radially inward and proximally from the distal base end, an axial portion extending proximally from the shoulder portion towards an inner face of the casing head, and a circumferential groove between the distal inner face of the casing head and at least a portion of the axial portion, wherein the circumferential groove has a groove radius greater than a radius of the axial portion; and a casing body secured to the casing base and having a tubular sleeve portion extending along the central axis from a proximal sleeve end to a distal sleeve end, a proximal body portion connected to the proximal sleeve end and including (i) a sleeve shoulder extending along the shoulder portion of the casing base, (ii) an axial sidewall extending along the axial portion of the casing base, and (iii) a flange protruding radially outward from the axial sidewall and mating with the circumferential groove;

wherein the flange includes a proximal flange portion and a distal flange portion each extending radially outward in an axially spaced-apart orientation with respective outer radial end portions connected by an axial flange sidewall, and wherein the flange defines a locking chamber between the proximal flange portion and the distal flange portion.

11. The ammunition cartridge casing of claim 10 further comprising an annular washer disposed at least partially in the locking chamber.

12. The ammunition cartridge casing of claim 11, wherein the annular washer has a Shore hardness from D55 to D86 or a Brinell harness from B30 to B101.

13. The ammunition cartridge casing of claim 11, wherein the annular washer comprises a material selected from ABS plastic, acetal, low density polyethylene, high density polyethylene, high-impact polystyrene, nylon, polycarbonate, polypropylene, polyetherimide, aluminum, aluminum alloy, copper, a copper alloy, brass, and gilding metal.

14. The ammunition cartridge casing of claim 10, wherein the casing head defines a centrally located primer pocket extending axially into the casing base, wherein the opening is axially spaced from the centrally located primer pocket by a portion of the casing base defining a flash opening between the primer pocket and the casing body.

15. A cartridge casing comprising:

a casing base of a first metal and extending along a central axis from a casing head to a distal base end, the casing base having an inside surface defining a primer pocket in the casing head, the primer pocket having a first diameter;

an open region situated distally of the primer pocket, the open region having a distal portion with a second diameter and a proximal portion with a third diameter greater than the second diameter; and an annular wall between the primer pocket and the open region, the annular wall having a distal face and defining a flash opening between the primer pocket and the proximal portion of the open region, the flash opening having an opening diameter smaller than the first diameter and smaller than the third diameter; and a casing body of a second metal, the casing body secured to the casing base, the casing body having a tubular sleeve portion extending distally from the casing base and having a proximal body portion disposed in the open region of the casing base, wherein the proximal body portion extends along and mates with the inside surface of the open region, the proximal body portion further including a proximal body wall engaging and extending radially inward along the distal face of the annular wall and defining an opening around the flash opening.

16. The cartridge casing of claim 15 further comprising an annular washer within the proximal body portion, the annular washer having an outer diameter greater than the second diameter and spaced from the distal face of the annular wall by a portion of the proximal body portion of the casing body.

17. The cartridge casing of claim 15, wherein the inside surface of the casing base defines a plurality of facets along the distal portion of the open region.

18. The cartridge casing of claim 15, wherein the second metal is compositionally distinct from the first metal.

19. The cartridge casing of claim 15, wherein the second metal is different from the first metal in at least one of a density and a tensile strength.

20. The cartridge casing of claim 15, wherein the cartridge casing has an ultimate tensile strength of at least 70,000 psi.

21. The cartridge casing of claim 15 further comprising:

a projectile retained in a mouth of the casing body;

a primer in the primer pocket; and a quantity of propellant in the casing body between the projectile and the primer.

22. The cartridge casing of claim 21, wherein the cartridge casing is a rifle cartridge.

* * * * *